United States Patent [19]

Müller

[11] Patent Number: 4,599,043

[45] Date of Patent: Jul. 8, 1986

[54] CONTROLLABLE PITCH PROPELLER AND WATERCRAFT DRIVE

[76] Inventor: Peter Müller, Widmerstrasse 27, Zürich, Switzerland

[21] Appl. No.: 649,373

[22] Filed: Sep. 11, 1984

[30] Foreign Application Priority Data

Sep. 22, 1983 [CH] Switzerland ..... 5159/83

[51] Int. Cl.[4] ..... B63H 3/08

[52] U.S. Cl. ..... 416/162; 416/167

[58] Field of Search ..... 416/162, 167, 164, 166

[56] References Cited

U.S. PATENT DOCUMENTS

| | | | |
|---|---|---|---|
| 954,539 | 4/1910 | Pawlik | 416/164 X |
| 1,832,075 | 11/1931 | Wilson | 416/164 X |
| 1,857,319 | 5/1932 | Monroe | 416/167 |
| 1,862,235 | 6/1932 | Morris | 416/164 |
| 1,891,384 | 12/1932 | Gillis et al. | 416/164 X |
| 2,010,640 | 8/1935 | Michl | 416/166 X |
| 3,095,932 | 7/1963 | Hercules | 416/166 |

FOREIGN PATENT DOCUMENTS

| | | | |
|---|---|---|---|
| 1097309 | 1/1961 | Fed. Rep. of Germany | 416/166 |
| 382091 | 1/1908 | France | 416/167 |
| 889767 | 1/1944 | France | 416/166 |
| 105599 | 7/1982 | Japan | 416/167 |
| 115712 | 1/1946 | Sweden | 416/166 |

OTHER PUBLICATIONS

A.P.C. application Ser. No. 362,280; May 18, 1943, of Praüse et al.

*Primary Examiner*—Everette A. Powell, Jr.
*Attorney, Agent, or Firm*—Walter C. Farley

[57] ABSTRACT

A controllable pitch propeller assembly has an inner housing attached to a main drive shaft, the housing having rails on the outer surface thereof. Modules carrying the propeller blades are positively mounted on the rails, each module having a housing receiving a hub cylinder and bushings axially aligned at opposite sides thereof. Each pair of bushings receives an adjusting piston having an adjusting pin which engages a groove forming a control path in a propeller hub. Each blade is adjusted by a control lever which adjusts each adjusting piston through a mechanical linkage including an adjusting sleeve and a thurst bearing and flange.

9 Claims, 4 Drawing Figures

CONTROLLABLE PITCH PROPELLER AND WATERCRAFT DRIVE

This invention relates to a controllable pitch propeller assembly and to a watercraft drive including such an assembly in which the propeller blades and hubs are pivotably mounted in a housing attached to the main propeller shaft such that their pitch is variable by operation of an adjusting lever.

BACKGROUND OF THE INVENTION

Controllable pitch propellers are used to a considerable extent on watercraft, particularly ships. Variation in the propeller pitch facilitates maneuvering and permits an optimum propeller blade setting for the selected speed and power of the propeller drive motor.

Some sort of power system is necessary for setting the pitch of the propeller blades. A manual adjustment device can only be used in connection with very small controllable pitch propellers because, with larger propellers, it is simply not possible to manually alter the propeller pitch while the vessel is being driven because of the large forces involved. Known adjustment devices include a lever operable from the vessel which acts on an adjustment sleeve mounted on the outflow side of the propeller hub and on which is arranged a thrust bearing forming a transition to the rotary system, i.e., the rotating propeller blades.

In the propulsion system of a larger ship, hydraulic adjustment drive systems can be used in which a single hydraulic cylinder causes the adjustment of the propeller pitch. A pressure medium, usually hydraulic oil, is necessary for the adjustment and fixing of the propeller blades and is introduced into the hub by means of a supply line while the used pressure medium is led back through a return line. In such a hydraulic circuit, the transition from the stationary to the rotary portion of the controllable pitch propeller constitutes a problem area at which leakage losses can occur. However, additional leakage losses can also occur in the hub and the leaking pressure medium cannot be collected and returned. Thus, the hydraulic oil passes out into the water and becomes a source of pollution.

A completely hydraulic adjustment device of this general type is reliable but is costly and can only be economically installed on large ships.

On smaller ships and particularly on motorboats, the controllable pitch propeller has only been used to a limited extent because of the aforementioned problems. Certain conditions must be satisfied to permit replacement of the presently used fixed propellers with controllable pitch propellers. The dimensions of the controllable pitch propeller, particularly with respect to the hub diameter and weight, must not differ significantly from the presently used fixed propeller. In addition, the adjustment device must have a simpler construction than the known hydraulic adjustment devices.

BRIEF SUMMARY OF THE INVENTION

Accordingly, an object of the present invention is to provide a controllable pitch propeller assembly which is relatively simple, compact and light-weight and which can be used with watercraft of smaller sizes.

A further object is to provide a power driven controllable pitch propeller assembly in which the weight and dimensions are similar to those of fixed propellers and which does not involve a water polluting leakage problem.

Briefly described, the invention includes a controllable pitch propeller assembly for driving a watercraft comprising a main drive shaft, outer housing means attached to the shaft for rotation therewith, a plurality of propeller blades, each having a propeller hub pivotably attached to said outer housing means so that the pivoting of each said hub adjusts the pitch of its associated blade, an inner housing, means for removably mounting the outer housing means on the periphery of the inner housing, an adjusting lever and means coupled to the lever for pivoting the propeller hubs.

The invention further includes a drive for a watercraft with a controllable pitch propeller assembly as described wherein the adjusting lever is constructed as a double-armed lever, one arm of which engages the pivoting means, and the other arm is driven by a linear motor which is mounted in a spaced relationship from the propeller.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF THE PREFERRED EMBODIMENTS

Figure 1:
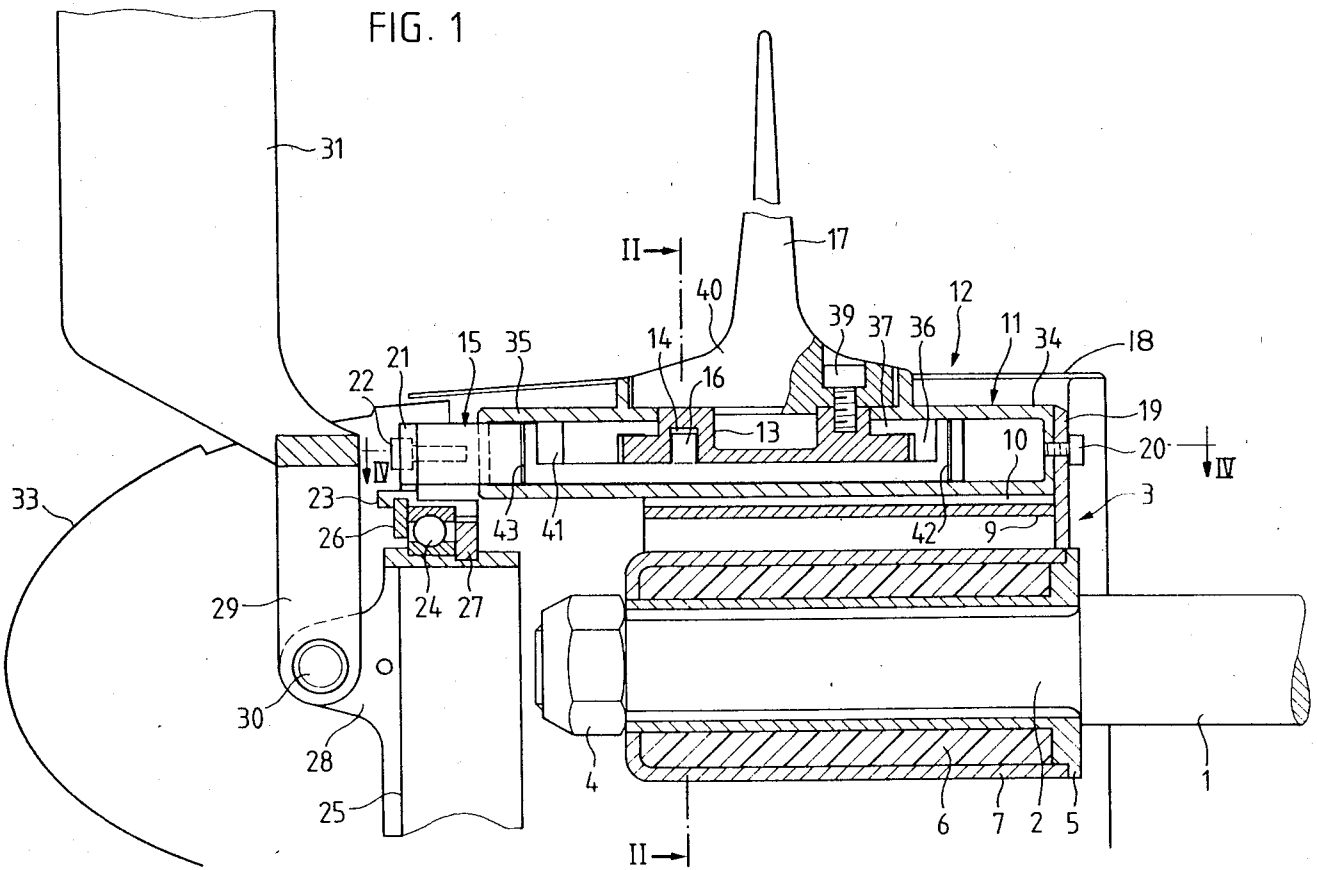
FIG. 1 is a partial side elevation, partly in section, of a controllable pitch propeller assembly in accordance with the invention.
Figure 2:
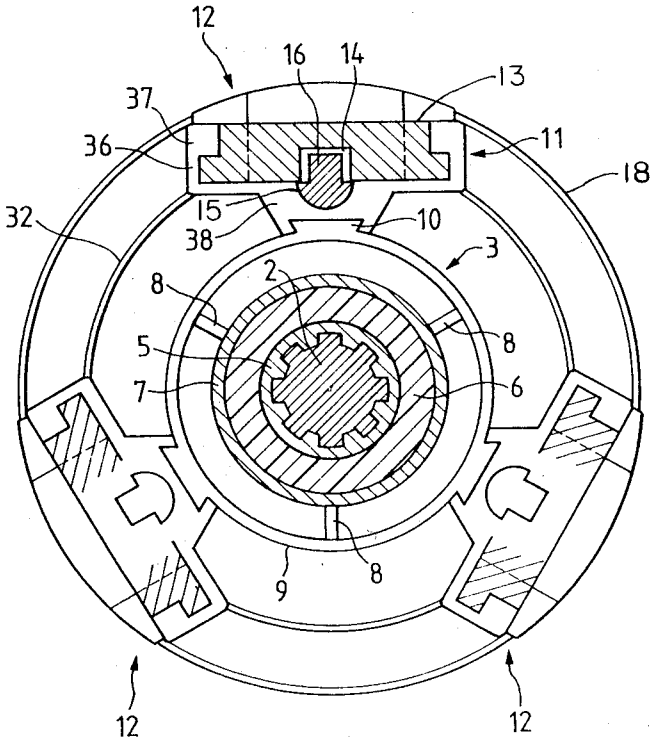
FIG. 2 is a transverse sectional view along line II—II of FIG. 1.
Figure 4:
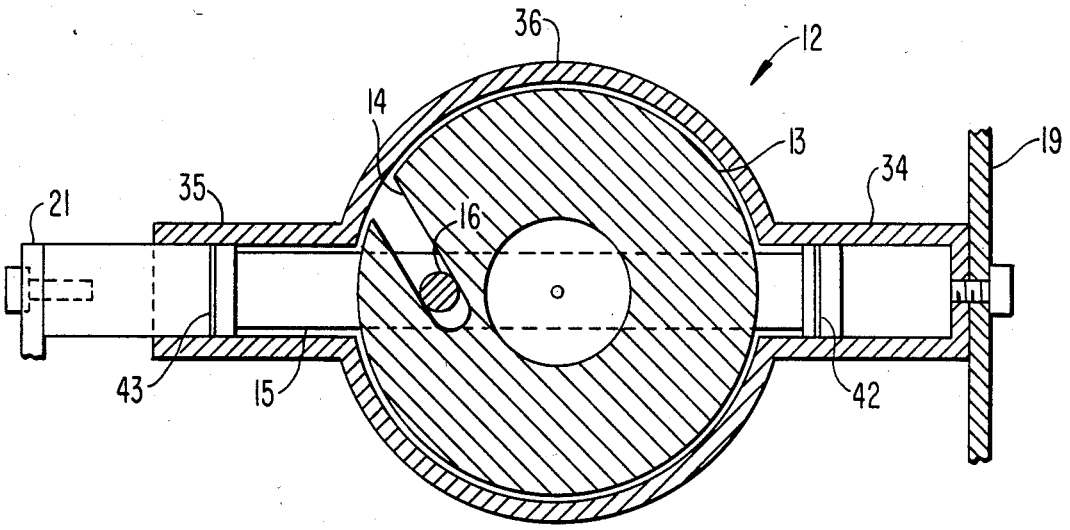

As shown in FIG. 1, a propeller assembly in accordance with the invention includes a main drive shaft 1 which is coupled to the source of propulsion, for the watercraft, shaft 2 having a splined end portion 2 on which is mounted an inner housing indicated generally at 3, the housing being attached to the shaft by a nut 4. The inner housing 3 is a generally cylindrical body having a splined sleeve 5 surrounded by and embedded in an elastic sleeve 6 which is, in turn, surrounded by a metal sleeve 7. Three axially extending radial webs 8 (FIG. 2) are attached to and extend outwardly from sleeve 7 and support a bearing sleeve 9. A plurality of support rails 10 are uniformly distributed around the outer circumference of bearing sleeve 9 and, as shown in FIG. 2, have a dovetail cross section. Each support rail 10 forms a support for an outer housing 11 which is part of an outer housing module 12. Taken together, the modules 12 form an outer housing means for supporting the propellers, each housing 11 being shaped to receive a propeller hub 13 which has a transverse groove 14 defining a control path, best seen in FIG. 4. Housing 11 also receives an adjusting piston 15 which has a protruding adjusting pin 16, which projects into control path 14. It will be observed that each module 12 is essentially independent in the sense that any number of such modules can be used depending upon whether 2, 3 or 4 propeller blades 17 are to be provided. It is merely necessary for the inner housing 3 to be provided with a suitable number of rails 10 corresponding to the number of modules 12 and blades 17 and, in addition, to conform the diameter of bearing sleeve 9 to the requirements of the particular structural arrangement. Internal housing 3 and modules 12 form a space-saving light-weight construction making it possible to use similar propeller hub diameters to those used with propeller assemblies having fixed blades. The hub structure consisting of internal housing 3, and modules 12, can be covered by a light-weight external hub 18 which need not absorb large forces and can consequently be made from a light-weight material such as plastic.

For absorbing the axial thrust which occurs, inner housing 3 has a front wall 19 which supports modules 12 which are held in position by screws 20.

The individual blades 17 are jointly adjusted. Thus, pistons 15 are interconnected at one end by an annular adjusting flange 21 which is connected to the pistons 15 by screws 22. On the inner side of flange 21 is a generally cylindrical connecting piece 23 which forms the seat for the outer race of an axial roller bearing 24, the inner race of which is mounted on a generally cylindrical adjusting sleeve 25. The axial roller bearing 24 is held in its axial position by rings 26 and 27 attached, respectively, to rings 23 and 25 to function as retaining rings. Thus, when force is exerted in an axial direction on adjusting sleeve 25, adjusting pistons 15 are simultaneously repositioned. The adjusting sleeve 25 has two cover plates 28 with bores between which is pivotably mounted a flat bar or link 29 by means of a bolt 30. Link 29 is part of a control lever 31, the arrangement of which will be described in connection with FIG. 3.

The inner area of the hub formed by inner housing 3 and modules 12 has several open spaces which can be employed for drawing off motor or engine gases from the drive motor or engine for the watercraft. In such a case, the inner housing has a further sleeve 32 which is illustrated in FIG. 2. Alternatively, the structure can be provided with an end cap 33 as shown in FIG. 1 which terminates the hub.

Each adjusting piston 15 is guided in two coaxial bushings 34 and 35 which form a part of housing 11 at opposite ends thereof and are integrally connected to a hub cylinder 36. Thus, housing 11 comprises hub cylinder 36 which has an inwardly protruding collar 37 and the two bushings 34, 35. On the side of this housing which faces toward the main drive shaft is a guide web 38 which is provided with a recess shaped and dimensioned so that it can be removably mounted on one of the support rails 10 of bearing sleeve 9. Rails 10 and guides 38 form a positive, play-free connection.

Propeller hub 13 is connected by screws 39 to the base 40 of a propeller blade 17 and is guided on the inner collar 37 of hub cylinder 36 in both axial and radial directions. Because the propeller hub 13 moves slidingly with respect to inner collar 37 during the adjustment of the propeller blade pitch, the contacting surfaces thereof can be coated with a sliding or lubricating material. To be sure that propeller hub 13 and adjusting piston 15 occupy minimum space, the central portion of the piston is provided with a recess 41 which receives propeller hub 13 which receives adjusting pin 16 in the recess 14 forming the control path. When a propeller blade 17 is installed on one of modules 12, the blade with its propeller hub 13 is initially slipped into hub cylinder 36. Then, to permit the assembly of adjusting piston 15 into bushing 34, a semicircular diagonal recess (not shown) is provided in hub 13 and, during assembly, the hub is turned until the recess is aligned with bushings 34, 35, permitting piston 15 to be inserted therethrough. The propeller blade 17 is then turned until adjusting pin 16 can be introduced into groove 14 defining the control path. On the ends of piston 15 are provided elastic gaskets such as O-rings 42 and 43 which seal recess 41 from the outside, recess 41 being filled with a lubricant. The external sealing at propeller blade base 14 takes place on the bearing surface of inner collar 37 and by sealing screw 39 so that a completely closed space exists, insuring the lubrication of the sliding surfaces in the vicinity of collar 37.

The operation of this portion of the apparatus is believed to be clear from the above, but will be briefly reviewed. As piston 15 is moved axially with respect to bushings 35 and 34, pin 16 is caused to move axially, carrying with it groove 14 and causing propeller hub 13 to rotate within the space 41, thereby also rotating blade 17 and changing its pitch with respect to the axis of main drive shaft 1.

Figure 3:
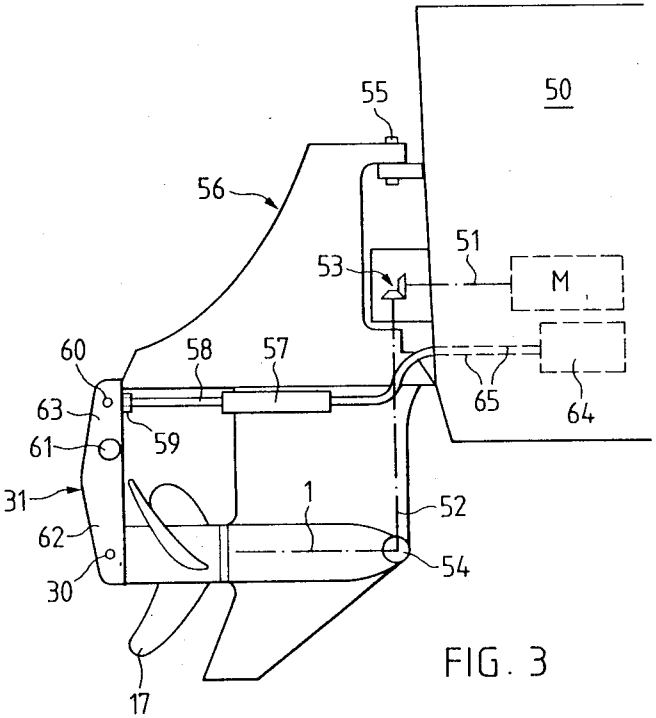
FIG. 3 is a side elevation of the rear portion of a watercraft having a drive assembly in accordance with the invention mounted thereon and FIG. 4 is a sectional view along the line IV—IV of FIG. 1.

FIG. 3 shows a complete drive for a watercraft with a controllable pitch propeller in accordance with the invention as shown in FIGS. 1 and 2. The controllable pitch propeller is driven by a schematically represented motor or engine M by means of a so-called Z drive which is supported in the hull of watercraft 50. In this kind of a drive, main shaft 1 does not extend obliquely through the hull but, rather, the torque is transmitted from the drive motor through shafts 51, 52 and bevel gears 53, 54 to main shaft 1. In the side view of FIG. 3, shafts 1, 51 and 52 form a roughly Z-like configuration. The controllable pitch propeller, together with shafts 1 and 52, is located in a rudder member 56 pivotable about the axis of a vertical pintle 35 supported at the end of the hull. Member 56 comprises several rudder parts, a casing and a bearing for the main shaft 1 which is not shown.

The adjustment device for adjusting the propeller blade 17 comprises a linear motor 57 which can be a hydraulic piston and cylinder assembly, the piston rod 58 of which is articulated by means of a pivot or adjustment screw 59 to a swivel joint 60 of control lever 31. Lever 31 is formed as a double-armed lever with a central pivot 61, one arm 62 of this lever acting on adjusting sleeve 25 and the other arm 63 being acted upon through swivel joint 60 by linear motor 57. The linear motor can suitably be installed in rudder member 56, but it can also be arranged on either side thereof so long as precautions are taken to ensure the necessary symmetry for power transmission. The linear motor is supplied with the necessary energy from a power source 64 through line 65 in a conventional fashion.

Linear motor 57 can also be mounted in the hull of watercraft 50. In this case, a corresponding transmission lever is provided which acts on joint 60 of control lever 31. There is no need for the controllable pitch propeller to be installed in rudder 56 as it can easily be attached directly to the hull. In this case, there is a particularly simple connection between linear motor 57 and control lever 31. What is important is to completely detach the known hydraulic adjustment devices from the propeller hubs so that there is no need for a complicated guidance of the pressure medium. Nevertheless, the adjustment system described makes it possible to solve the problem of adjusting the propeller blade 17 in an optimum manner because the adjustment mechanism installed in the modules 12 is protected and lubricated in a highly efficient fashion. The passage of the adjustment movement from control lever 31 to the rotary parts of the controllable pitch propeller takes place on the outflow side because there is then no need to be concerned about main shaft 1. However, lever 31 could also be arranged on the incident flow or attack side without a fundamental change of the conditions. In each case, linear motor 57 is positioned remotely from the controllable pitch propeller itself and accomplishes the adjustment by means of a propeller lever bar. If linear motor 57 is constructed as a double-acting hydraulic cylinder, it is possible to produce sufficiently large adjustment forces to enable the preselected propeller settings to be maintained in the case of, for example, vibrations or contact with external bodies.

The desired pitch of the propeller blades can thus be rapidly and accurately controlled. As a result, the propeller itself becomes less complicated and a light-weight construction can be used for inner housing 3 while modules 12 contain in a compact form the adjustment parts and the propeller blade bearings. With respect to modules 12, housing 11 can be a cast metal part of a light metal while the propeller hub 13 and piston 15 can be made, for example, from steel.

While certain advantageous embodiments have been chosen to illustrate the invention it will be understood by those skilled in the art that various changes and modifications can be made therein without departing from the scope of the invention as defined in the appended claims.

What I claim is:

1. A controllable pitch propeller assembly for driving a watercraft comprising a main drive shaft;

housing means attached to said shaft for rotation therewith, said housing means including an inner and a plurality of separated outer housing portions attached to said inner housing portion;

a plurality of propeller blades;

a plurality of rotatable propeller hub means for rotatably supporting said blades for rotation about their own axes, each said propeller blade being associated with one of said hub means in a propeller-hub means assembly;

a plurality of adjusting mechanisms, one on each of said outer housing portions, each said mechanism being operatively associated with one of said propeller and hub means assemblies, each said adjusting mechanism including a hub cylinder rotatably supporting one of said hub means, an adjustment piston, first and second cylinder bushings integrally attached to said hub cylinder and extending from opposite sides thereof, said bushings forming a cylinder for said piston, said piston being longitudinally movable in the cylinder formed by both of said bushings, and means coupling said piston to said hub means so that longitudinal movement of said piston rotates said hub means;

an adjustment lever; and linkage means for connecting said lever to all of said piston so that movement of said lever concurrently moves said pistons and rotates said hub means and said propellers.

2. An assembly according to claim 1 and further including means for removably mounting said outer housing portions on said inner housing portion comprising a mounting web on each of said outer housing portions and a plurality of support rails axially extending along said inner housing portion, each rail being shaped to engage one of said webs.

3. An assembly according to claim 2 wherein each of said means coupling said piston to said hub means includes a protruding adjusting pin on each said piston, and wherein each said propeller hub means includes an adjustment slot for receiving said adjustment pin whereby longitudinal movement of said piston causes pivotal movement of said hub.

4. An assembly according to claim 3 and including a thrust bearing interconnecting each said adjustment piston and said adjustment lever.

5. A drive for a watercraft having a controllable pitch propeller assembly in accordance with claim 4 wherein said adjustment lever comprises a double-armed lever having one arm engaging said thrust bearing, said drive further including a linear motor, means for coupling said linear motor to the other arm of said lever, and means for mounting said linear motor in spaced relationship from said controllable pitch propeller.

6. A drive according to claim 5 wherein said linear motor is a double-acting hydraulic piston and cylinder assembly mounted adjacent the hull of the watercraft.

7. An assembly according to claim 1 wherein each said piston includes a recess for receiving said rotatable hub means, each said hub means includes a slot, and each said piston carries an adjusting pin extending into the slot in the associated one of said hub means.

8. An assembly according to claim 7 wherein each said outer housing portion comprises a closed space for containing one of said hub means and one of said pistons so that the components for changing linear to rotary motion are isolated.

9. An assembly according to claim 8 wherein the interior volume of said closed space around said piston and hub means remains constant as said components move whereby no positive or negative pressure is produced therein by said movement.

* * * * *